US008268127B2

(12) United States Patent
Liu et al.

(10) Patent No.: US 8,268,127 B2
(45) **Date of Patent: *Sep. 18, 2012**

(54) METHOD OF DEGUMMING JUTE FIBRES WITH COMPLEX ENZYME

(75) Inventors: Guozhong Liu, Jiangsu (CN); Zhenhua Zhang, Jiangsu (CN)

(73) Assignee: Jiangsu Redbud Textile Technology Co., Ltd. (JP)

( * ) Notice: Subject to any disclaimer, the term of this patent is extended or adjusted under 35 U.S.C. 154(b) by 125 days.

This patent is subject to a terminal disclaimer.

(21) Appl. No.: 12/680,455

(22) PCT Filed: Sep. 26, 2008

(86) PCT No.: PCT/CN2008/001660

§ 371 (c)(1),
(2), (4) Date: Mar. 26, 2010

(87) PCT Pub. No.: WO2009/049485

PCT Pub. Date: Apr. 23, 2009

(65) Prior Publication Data

US 2010/0307703 A1 Dec. 9, 2010

(30) Foreign Application Priority Data

Sep. 27, 2007 (CN) ..... 2007 1 0122576
Sep. 27, 2007 (CN) ..... 2007 1 0122586
Sep. 27, 2007 (CN) ..... 2007 1 0122598

(51) Int. Cl.
*D01C 1/02* (2006.01)
*D06L 1/14* (2006.01)

(52) U.S. Cl. ..... 162/98; 162/72; 162/99; 8/138; 435/275

(58) Field of Classification Search ..... 162/72, 162/98, 99; 8/138, 107; 435/275
See application file for complete search history.

(56) References Cited

U.S. PATENT DOCUMENTS 4,617,383 A * 10/1986 Jaskowski ..... 536/2
7,481,844 B2 * 1/2009 Liu et al. ..... 8/138
2007/0192964 A1 * 8/2007 Lui et al. ..... 8/115.51

FOREIGN PATENT DOCUMENTS

CN 1117538 A 2/1996
CN 1366043 A 8/2002
CN 1614105 A 5/2005
CN 1232691 C 12/2005
CN 101130887 A 2/2008
CN 101130888 A 2/2008
CN 101130889 A 2/2008
CN 101130890 A 2/2008
CN 101130892 A 2/2008
CN 101130893 A 2/2008
CN 101130894 A 2/2008
CN 101130895 A 2/2008
CN 1011360896 A 2/2008
CN 101135062 A 3/2008
CN 101135063 A 3/2008
CN 101135064 A 3/2008
CN 101135065 A 3/2008
CN 101167606 A 4/2008
CN 101168432 A 4/2008
CN 101172571 A 5/2008
CN 101187066 A 5/2008
EP 1795630 A1 6/2007

OTHER PUBLICATIONS

Introduction to Enzymes, Worthington biochemical Corporation, downloaded online Sep. 22, 2011.*
English Translation of priority documents CN 200710122576.5, CN200710122586.9, CN200710122598.1, submitted to the EPO for EP 08 800 652.3, Apr. 19, 2011.*
"English Translation of CN 1117538A, published Feb. 28, 1996", 7 pgs.
"English Translation of CN 1366043A, published Aug. 28, 2002", 8 pgs.
"International Application Serial No. PCT/CN2008/001660, International Preliminary Report on Patentability dated Mar. 30, 2010", (w/English Translation), 12 pgs.
"International Application Serial No. PCT/CN2008/001660, International Search Report mailed Jan. 8, 2009", (w/ English Translation), 8 pgs.
"International Application Serial No. PCT/CN2008/001660, Written Opinion mailed Jan. 8, 2009", (w/ English Translation), 10 pgs.
Lijun, Q., et al., "Research on New Process of Alkali-$H_2O_2$ One-bath for Jute Degumming & Bleaching" *Journal of Qingdao University*, 18(1), (Mar. 2003), 1-5.
Majumdar, S., et al., "Enyzmatic Retting of Jute Ribbons", *International Biodeterioration*, 27, (1990), 223-235.
Sampaio, S., et al., "Progress on Enzymatic Preparation of Flax and Flax/Wool Blends", *AATCC* Review, 5(5), (May 2005), 23-28.
Yabin, L., et al., "Impact of Enzymes Function on Properties of Jute Fibers" *Journal of Tianjin Polytechnic University*, 24(4), (Aug. 2005). 8 pgs.

* cited by examiner

*Primary Examiner* — Anthony Calandra
(74) *Attorney, Agent, or Firm* — Schwegman Lundberg & Woessner, P.A.

(57) ABSTRACT

A method of degumming jute fibers with complex enzyme, wherein said complex enzyme comprises pectinase and laccase, comprises the steps of: a. soaking the jute fibers in the water solution of said complex enzyme made from pectinase and laccase and adjusting the weight proportion of said complex enzyme water solution and said jute fibers; b. adjusting the PH value of said complex enzyme water solution, and adjusting the temperature of said complex enzyme water solution to a first temperature, then keeping said complex enzyme water solution with the first temperature for a certain period of time; c. adjusting the PH value of said complex enzyme water solution, and adjusting the temperature of said complex enzyme water solution to a second temperature; then, keeping said complex enzyme water solution with the second temperature for another period of time; d. conducting enzyme deactivation of the jute fibers processed with said complex enzyme.

2 Claims, No Drawings

METHOD OF DEGUMMING JUTE FIBRES WITH COMPLEX ENZYME

RELATED APPLICATIONS

This application is a nationalization under 35 U.S.C. 371 of PCT/CN2008/001660, filed Sep. 26, 2008, and published as WO 2009/049485 A1 on Apr. 23, 2009, which claims priority to Chinese Patent Application Serial No. 200710122576.5, filed Sep. 27, 2007; Chinese Patent Application Serial No. 200710122586.9, filed Sep. 27, 2007; and Chinese Patent Application Serial No. 200710122598.1, filed Sep. 27, 2007, which applications and publication are incorporated herein by reference in their entirety and made a part hereof.

TECHNICAL FIELD

The present invention relates to a method of degumming jute fibres, in particular, relates to a method of degumming jute fibres with complex enzyme.

BACKGROUND

Bast fabrics have gained more and more popularity with people, due to better moisture absorption & breathing, low electrostatic susceptibility, and the antibacterial strength of bast fibres. For making the bast fabrics, the materials adopted can mainly be linen fibre, and ramie fibre, or the fibre combination of said fibres with other fibres, such as cotton fibres, wool fibres, chemical fibres, silk fibres after being blended spun. Linen or ramie is expensive, and this is also the reason why the bast-fabric clothing has not been applied widely. However, Jute, which is cheaper than linen and ramie, has better hygroscopicity and drapability than linen and ramie, and also has great antibiotic ability. Therefore, jute has huge potentiality and application value in clothing making industry. As the content of lignin within jute is relatively high (reaching 10-13%), which is several times as much as that within linen, it is not effective to degum jute fibres and remove the lignin from jute by using the existing degumming technology. And this greatly restrains the application of jute in making clothing. <The Effect of Enzyme Treatment on Jute fibres >published in 《Jounal of Tianjin Industrial University》 volume 24 of August 2005 introduces the effect of cellulose, hemicellulase, ligninase and pectin depolymerise used in processing the jute fibres, but this article only introduces the method of processing jute fibres using single one of above mentioned enzymes. Although, there are some paragraphs in which the methods of complex enzyme treatment are mentioned, it only refers to the complex enzyme obtained via mixing laccase and cellulose enzyme or mixing hemicellulase enzyme and cellulose enzyme. However, it is testified in practice that it is not effective to remove lignin from jute fibres using the degumming method published in this article. Chinese Patent publication No CN 1232691C introduces a method of degumming jute with complex enzyme. In the method, pectinase and laccase are used to produce a complex enzyme for degumming jute fibres, and the degmmed jute fibres, after blended spun or interlaced with other fibres such as cotton fibres and chemical fibres, can generally meet the requirements for clothing materials. However, the effect of removing lignin from jute fibres in the method, is still not good enough, as the removal rate is only about 76%. The content of lignin remaining in the jute fibres is still very high. Therefore, there is a need of blended spinning or interlacing jute fibres with other fibres such as cotton fibres, and chemical fibres, when making the clothing materials. However, the quality of clothing materials made through blended spinning or interlacing jute fibres with other fibres such as cotton fibres, and chemical fibres still needs to be improved.

BRIEF DESCRIPTION OF INVENTION

The present invention relates to a method of degumming jute fibres with complex enzyme to effectively remove pectin and lignin from said jute fibres.

In the present invention, a method of degumming jute fibres with complex enzyme, wherein said complex enzyme comprises pectinase and laccase, comprises the steps of:

a. soaking the jute fibres in the water solution of said complex enzyme made from pectinase and laccase, where the weight proportion of said complex enzyme water solution and jute fibres ranges from 12:1 to 40:1.
b. adjusting the PH value of said complex enzyme water solution to 5.0-5.5, and adjusting the temperature of said complex enzyme water solution to 55□-60□, then keeping said complex enzyme water solution with such temperature for 20-120 minutes.
c. adjusting the PH value of said complex enzyme water solution to 7.5-9.5, and adjusting the temperature of said complex enzyme water solution to 40° C.-70° C.; then, keeping said complex enzyme water solution with such temperature for 20-120 minutes.
d. conducting enzyme deactivation of the jute fibres processed with said complex enzyme.

The method, wherein said jute fibres are accumulation stored before the step d.

The method, wherein the duration for accumulation storing said jute fibres ranges from 6 to 24 hours.

The method, wherein the enzyme deactivation of jute fibres in the step d is through washing with hot water or adjusting the PH value of jute fibres, or through the combination of the two means.

The method, wherein the weight percentage of pectinase in said complex enzyme ranges from 30% to 90%.

The method, wherein the weight proportion of said complex enzyme and jute fibres ranges from 0.5:100 to 5:100.

The method, wherein the temperature of said hot water is above 75° C.; the PH value of jute fibres is adjusted to above 10.0 or below 4.0.

The method, wherein said jute fibres is pre-processed before the step a.

The method, wherein the pre-processing of said jute fibres is either through one of the means of water bath, acid bath, and soaking with hydrogen Peroxide, or through the combination of at least two of the three means.

The method, wherein that the temperature of water bath ranges from 30° C. to 100° C.; Said acid is sulphuric acid or acetic acid.

This invention also provides another method of degumming jute fibres with complex enzyme, wherein said complex enzyme comprises pectinase and laccase, said method comprises the steps of:

a. soaking the jute fibres in the water solution of said complex enzyme made from pectinase and laccase, where the weight proportion of said complex enzyme water solution and jute fibres is 15:1, and the weight proportion of said complex enzyme and said jute fibres is larger than 2:100, and not larger than 5:100.
b. adjusting the PH value of said complex enzyme water solution to 5.0-5.5, and adjusting the temperature of said complex enzyme water solution to 55° C.-60° C., then keeping said complex enzyme water solution with such temperature for 25-50 minutes.

c. adjusting the PH value of said complex enzyme water solution to 7.5-8.0, and adjusting the temperature of said complex enzyme water solution to 60° C.-70° C.; then, keeping said complex enzyme water solution at such temperature for 25-50 minutes.

d. conducting enzyme deactivation of the jute fibres processed with said complex enzyme.

The method, wherein that said jute fibres are accumulation stored before the step d.

The method, wherein that the duration for accumulation storing said jute fibres ranges from 6 to 24 hours.

The method, wherein the enzyme deactivation of jute fibres in step d is through washing with hot water or adjusting the PH value of jute fibres, or through the both of the two means.

The method, wherein that the weight percentage of pectinase in said complex enzyme ranges from 30% to 90%.

The method, characterized in that the weight proportion of said complex enzyme and jute fibres ranges from 0.5:100 to 5:100.

The method, wherein that the temperature of said hot water is above 75° C.; the PH value of jute fibres is adjusted to above 10.0 or below 4.0.

The method, wherein that said jute fibres is pre-processed before the step a.

The method, wherein that pre-processing said jute fibres is either through one of the means of water bath, acid bath, and soaking with Hydrogen Peroxide, or through the combination of at least two of the three means.

The method, wherein that the temperature of water bath ranges from 30° C. to 100° C.; Said acid is sulphuric acid or acetic acid.

This invention further provides a method of degumming jute fibres with complex enzyme, wherein said complex enzyme comprises pectinase and laccase, said method comprises the steps of:

a. soaking the jute fibres in the water solution of said complex enzyme made from pectinase and laccase, where the weight proportion of said complex enzyme water solution and jute fibres ranges from 12:1 to 40:1.

b. adjusting the PH value of said complex enzyme water solution to 5.0-5.5, and adjusting the temperature of said complex enzyme water solution to 55□-60□, then keeping said complex enzyme water solution with such temperature for 25-50 minutes.

c. adjusting the PH value of said complex enzyme water solution to 7.5-8.0, and adjusting the temperature of said complex enzyme water solution to 60° C.-70° C.; then, keeping said complex enzyme water solution at such temperature for 51-120 minutes.

d. conducting enzyme deactivation of the jute fibres processed with said complex enzyme.

The method, wherein said jute fibres are accumulation stored before the step d.

The method, wherein that the duration of accumulation storing said jute fibres ranges from 6 to 24 hours.

The method, wherein that the enzyme deactivation of jute fibres in the step d is through washing with hot water or adjusting the PH value of jute fibres, or through the combination of the two means.

The method, wherein that the weight percentage of pectinase in said complex enzyme ranges from 30% to 90%.

The method, wherein that the weight proportion of said complex enzyme and jute fibres ranges from 0.5:100 to 5:100.

The method, wherein that the temperature of said hot water is above 75□; the PH value of jute fibres is adjusted to above 10.0 or below 4.0.

The method, wherein that said jute fibres is pre-processed before the step a.

The method, wherein that the pre-processing of said jute fibres is either through one of the means of water bath, acid bath, and soaking with hydrogen Peroxide, or through the combination of at least two of the three means.

The method, wherein that the temperature of water bath ranges from 30° C. to 100° C.; said acid is sulphuric acid or acetic acid.

In comparison with the prior art, the present invention has several advantages as follows:

(1) In the present invention, the process parameters that match with each other are used in treatment of degumming jute fibres with complex enzyme. Via adjusting the PH value of enzyme water solution to more than 8.0 (pectinase is in its highest activity when the PH value is within 8.0-9.0, and the activity of pectinase declines gradually along with the decline of PH value from 8.0 or the rise of PH value from 9.0), or adjusting the use of complex enzyme to the amount that is larger than 2% of jute fibre in weight, keeping the enzyme water solution within a PH value interval in which the pectinase is in a relatively high activity, and prolonging the holding time of the enzyme water solution up to 50 minutes or more, and accordingly adjusting other process parameters, in order to gain the best degumming effect. In addition, it is effective to remove pectin and lignin from jute fibres through accumulation storing the jute fibres before conducting enzyme deactivation of the jute fibres treated with complex enzyme via washing such jute fibres with hot water, or adjusting the PH value of such jute fibres. The removal rate of pectin can general reach about 90%, even up to 96% as the highest value, while the removal rate of lignin can generally reach about 78%, even up to 86% as the highest value. The jute fibres treated through above mentioned method have relatively high spinability.

(2) In addition, pre-processing jute fibres before being degummed can swell the jute fibres, so as to better reduce the interacting force among the single fibres, facilitate the contact between enzyme water solution and jute fibres, and remove the pectin and lignin from the jute fibres.

DETAILED DESCRIPTION OF INVENTION

EXAMPLE 1

An experiment is conducted through the following steps: firstly, dividing the jute fibres into several bits, wherein each bit of jute fibres weighs about 0.5 kilogram; secondly, pre-processing the bits of jute fibres through water bath, while the temperature of water bath is 65□, and the holding time is 2 hours; then, mixing the pectinase and laccase into complex enzyme, wherein the weight proportion of pectinase and laccase is 3:7, and the weight proportion of such complex enzyme and the jute fibres is 0.5:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating up the complex enzyme water solution to 55° C. and keeping the solution at such temperature for 20 minutes; after that, adjusting the PH value of the heated solution to 8.5 with sodium bicarbonate, heating up the solution to 65° C., and keeping the solution at such temperature for 20 minutes; then, taking the jute fibres out of the solution, and accumulation storing the jute fibres for 24 hours; next, conducting enzyme deactivation of the accumulation stored jute fibres by washing the jute fibres with hot water at 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 2

An experiment is conducted through the following steps: firstly, dividing the jute fibres into several bits, wherein each bit of jute fibres weighs about 0.5 kilogram; secondly, pre-processing the bits of jute fibres through both acid bath and water bath, while the acid used for acid bath is concentrated sulphuric acid with the concentration of above 90%.The temperature of water bath is 30□ and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 40 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating up the complex enzyme water solution to 60° C. and keeping the solution at such temperature for 120 minutes; after that, adjusting the PH value of the heated solution to 9.5 with sodium bicarbonate, heating up the solution to 55° C., and keeping the solution at such temperature for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 3

An experiment is conducted through the following steps: firstly, dividing the jute fibres into several bits, wherein each bit of jute fibres weighs about 0.5 kilogram; secondly, pre-processing the bits of jute fibres through both acid bath, while the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 1:100; next, diluting the complex enzyme with water, in order to produce complex enzyme water solution which is 20 times in weight as much as the jute fibres; after that, soaking the jute fibres in the diluted complex enzyme water solution; then, adjusting the PH value of the diluted complex enzyme water solution to 5.5 with acetic acid and sodium bicarbonate; next, heating up the complex enzyme water solution to 55° C. and keeping the solution at such temperature for 40 minutes; after that, adjusting the PH value of the heated solution to 8.5 with sodium bicarbonate, heating up the solution to 50° C., and keeping the solution at such temperature for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 4

An experiment is conducted through the following steps: firstly, dividing the jute fibres into several bits, wherein each bit of jute fibres weighs about 0.5 kilogram; secondly, pre-processing the bits of jute fibres through soaking the jute fibres in hydrogen peroxide with the concentration of 5 g/L, then, mixing the pectinase and laccase into complex enzyme, wherein the weight proportion of pectinase and laccase is 2:1, and the weight proportion of such complex enzyme and the jute fibres is 2:100; next, diluting the complex enzyme with water, in order to produce complex enzyme water solution which is 30 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating up the complex enzyme water solution to 59° C. and keeping the solution at such temperature for 50 minutes; after that, adjusting the PH value of the heated solution to 9.0 with sodium bicarbonate, heating up the solution to 60° C., and keeping the solution at such temperature for 80 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 5

An experiment is conducted through the following steps: firstly, dividing the jute fibres into several bits, wherein each bit of jute fibres weighs about 0.5 kilogram; secondly, pre-processing the bits of jute fibres through water bath, while the temperature of water bath is 100□, and the holding time is half an hours; then, mixing the pectinase and laccase into complex enzyme, wherein the weight proportion of pectinase and laccase is 5:1, and the weight proportion of such complex enzyme and the jute fibres is 3:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.1 with acetic acid and sodium bicarbonate; next, heating up the complex enzyme water solution to 60° C. and keeping the solution at such temperature for 60 minutes; after that, adjusting the PH value of the heated solution to 8.5 with sodium bicarbonate, heating up the solution to 45° C., and keeping the solution at such temperature for 70 minutes; then, taking the jute fibres out of the solution, and accumulation storing the jute fibres for 20 hours; next, conducting enzyme deactivation of the accumulation stored jute fibres by washing the jute fibres with water solution, the PH value of which is 11.0; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 6

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 4:100; next, diluting the complex enzyme with water, in order to produce complex enzyme water solution which is 14 times in weight as much as jute fibres; after that, soaking the jute fibres in the diluted complex enzyme water solution; then, adjusting the PH value of the diluted complex enzyme water solution to 5.2 with acetic acid and sodium bicarbonate; next, heating up the complex enzyme water solution to 58° C. and keeping the solution at such temperature for 70 minutes; after that, adjusting the PH value of the heated solution to 9.0 with sodium bicarbonate, heating up the solution to 40° C., and keeping the solution at such temperature for 90 minutes; then, taking the jute fibres out of the solution, and accumulation storing the jute fibres for 12 hours; next, conducting enzyme deactivation of the accumulation stored jute fibres by washing the jute fibres with water solution, the PH value of which is 3.0; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 7

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 1:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.3 with acetic acid and sodium bicarbonate; next, heating up the complex enzyme water solution to 57° C. and keeping the solution at such temperature for 80 minutes; after that, adjusting the PH value of the heated solution to 8.3 with sodium bicarbonate, heating up the solution to 65° C., and keeping the solution at such temperature for 100 minutes; then, taking the jute fibres out of the solution, and accumulation storing the jute fibres for 8 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 8

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 56° C. and keeping the solution at such temperature for 90 minutes; after that, adjusting the PH value of the heated solution to 8.1 with sodium bicarbonate, heating the solution to 70° C., and keeping the solution at such temperature for 110 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 9

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 1:100; next, diluting the complex enzyme with water, in order to produce complex enzyme water solution which is 16 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 55° C. and keeping the solution at such temperature for 100 minutes; after that, adjusting the PH value of the heated solution to 8.2 with sodium bicarbonate, heating the solution to 55° C., and keeping the solution at such temperature for 120 minutes; then, taking the jute fibres out of the solution; next, conducting enzyme deactivation of the jute fibres by washing the jute fibres with hot water, the PH value of which is 3.5 and the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 10

An experiment is conducted through the following steps: firstly, dividing the jute fibres into several bits, wherein each bit of jute fibres weighs about 0.5 kilogram; secondly, preprocessing the bits of jute fibres through water bath, while the temperature of water bath is 65□, and the holding time is 2 hours; then, mixing the pectinase and laccase into complex enzyme, wherein the weight proportion of pectinase and laccase is 3:7, and the weight proportion of such complex enzyme and the jute fibres is 2.1:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 55° C. and keeping the solution at such temperature for 25 minutes; after that, adjusting the PH value of the heated solution to 7.5 with sodium bicarbonate, heating the solution to 60° C., and keeping the solution at such temperature for 25 minutes; then, taking the jute fibres out of the solution, and accumulation storing the jute fibres for 24 hours; next, conducting enzyme deactivation of the accumulation stored jute fibres by washing the jute fibres with hot water at 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 11

An experiment is conducted through the following steps: firstly, dividing the jute fibres into several bits, wherein each bit of jute fibres weighs about 0.5 kilogram; secondly, preprocessing the bits of jute fibres through both acid bath and water bath, while the acid used for acid bath is concentrated sulphuric acid with the concentration of above 90%.The temperature of water bath is 30□ and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 50 minutes; after that, adjusting the PH value of the heated solution to 7.5 with sodium bicarbonate, heating the solution to 65° C., and keeping the solution at such temperature for 40 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 12

An experiment is conducted through the following steps: firstly, dividing the jute fibres into several bits, wherein each bit of jute fibres weighs about 0.5 kilogram; secondly, preprocessing the bits of jute fibres through acid bath, while the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 4:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 40 minutes; after that, adjusting the PH value of the heated solution to 8.0 with sodium bicarbonate, heating the solution to 60° C., and keeping the solution at such temperature for 50 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 13

An experiment is conducted through the following steps: firstly, dividing the jute fibres into several bits, wherein each bit of jute fibres weighs about 0.5 kilogram; secondly, preprocessing the bits of jute fibres through soaking the jute fibres in hydrogen peroxide with the concentration of 5 g/L. then, mixing the pectinase and laccase into complex enzyme, wherein the weight proportion of pectinase and laccase is 2:1, and the weight proportion of such complex enzyme and the jute fibres is 4:100; next, diluting the complex enzyme with water, in order to produce complex enzyme water solution which is 15 times in weight as much as the jute fibres; after that, soaking the jute fibres in the diluted complex enzyme water solution; then, adjusting the PH value of the diluted complex enzyme water solution to 5.3 with acetic acid and sodium bicarbonate; next, heating the complex enzyme water solution to 58° C. and keeping the solution at such temperature for 50 minutes; after that, adjusting the PH value of the heated solution to 7.8 with sodium bicarbonate, heating the solution to 70° C., and keeping the solution at such temperature for 30 minutes; then, taking the jute fibres out of the solution, and accumulation storing the jute fibres for 12 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 14

An experiment is conducted through the following steps: firstly, dividing the jute fibres into several bits, wherein each bit of jute fibres weighs about 0.5 kilogram; secondly, preprocessing the bits of jute fibres through water bath, while the temperature of water bath is 100□, and the holding time is half an hours; then, mixing the pectinase and laccase into complex enzyme, wherein the weight proportion of pectinase and laccase is 5:1, and the weight proportion of such complex enzyme and the jute fibres is 3.5:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 30 minutes; after that, adjusting the PH value of the heated solution to 7.7 with sodium bicarbonate, heating the solution to 65° C., and keeping the solution at such temperature for 40 minutes; then, taking the jute fibres out of the solution, and accumulation storing the jute fibres for 20 hours; next, conducting enzyme deactivation of the accumulation stored jute fibres by washing the jute fibres with water solution, the PH value of which is 11.0; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 15

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 3:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 45 minutes; after that, adjusting the PH value of the heated solution to 8.0 with sodium bicarbonate, heating the solution to 65° C., and keeping the solution at such temperature for 45 minutes; then, taking the jute fibres out of the solution, and accumulation storing the jute fibres for 15 hours; next, conducting enzyme deactivation of the accumulation stored jute fibres by washing the jute fibres with water solution, the PH value of which is 3.5; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 16

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 2.5:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.2 with acetic acid and sodium bicarbonate; next, heating the complex enzyme water solution to 57° C. and keeping the solution at such temperature for 35 minutes; after that, adjusting the PH value of the heated solution to 8.0 with sodium bicarbonate, heating the solution to 65° C., and keeping the solution at such temperature for 35 minutes; then, taking the jute fibres out of the solution, and accumulation storing the jute fibres for 8 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 17

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 4.5:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 58° C. and keeping the solution at such temperature for 35 minutes; after that, adjusting the PH value of the heated solution to 7.8 with sodium bicarbonate, heating the solution to 70° C., and keeping the solution at such temperature for 45 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 18

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 2.5:100; next, diluting the complex enzyme with water, in order to produce complex enzyme water solution which is 15 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 56° C. and keeping the solution at such temperature for 25 minutes; after that, adjusting the PH value of the heated solution to 7.6 with sodium bicarbonate, heating the solution to 65° C., and keeping the solution at such temperature for 30 minutes; then, taking the jute fibres out of the solution; next, conducting enzyme deactivation of the jute fibres by washing the jute fibres with hot water, the PH value of which is 3.0 and the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 19

An experiment is conducted through the following steps: firstly, dividing the jute fibres into several bits, wherein each bit of jute fibres weighs about 0.5 kilogram, and pre-processing the jute fibres via water bath, wherein the temperature of the water is 65° C. and the holding time is 2 hours; secondly, mixing the pectinase and laccase into complex enzyme, wherein the weight proportion of pectinase and laccase is 3:7, and the weight proportion of such complex enzyme and the jute fibres is 0.5:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.5 with acetic acid and sodium bicarbonate; next, heating the complex enzyme water solution to 55° C. and keeping the solution at such temperature for 50 minutes; after that, adjusting the PH value of the heated solution to 7.5 with sodium bicarbonate, heating the solution to 60° C., and keeping the solution at such temperature for 51 minutes; then, taking the jute fibres out of the solution, and accumulation storing the jute fibres for 24 hours; next, conducting enzyme deactivation of the jute fibres by washing the jute fibres with hot water, the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 20

An experiment is conducted through the following steps: firstly, dividing the jute fibres into several bits, wherein each bit of jute fibres weighs 0.5 kilogram; secondly, pre-processing the bits of jute fibres through both acid bath and water bath, while the acid used for acid bath is concentrated sulphuric acid with the concentration of above 90%.The temperature of water bath is 30□ and the holding time is 1 hour; then, mixing the pectinase and laccase into complex enzyme, wherein the weight proportion of pectinase and laccase is 9:1, and the weight proportion of such complex enzyme and the jute fibres is 5:100; next, diluting the complex enzyme with water, in order to produce complex enzyme water solution which is 40 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 25 minutes; after that, adjusting the PH value of the heated solution to 7.5 with sodium bicarbonate, heating the solution to 65° C., and keeping the solution at such temperature for 120 minutes; then, taking the jute fibres out of the solution, and accumulation storing the jute fibres for 6 hours; next, conducting enzyme deactivation of the accumulation stored jute fibres by washing the jute fibres with hot water at 95° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 21

An experiment is conducted through the following steps: firstly, dividing the jute fibres into several bits, wherein each bit of jute fibres weighs 0.5 kilogram; secondly, pre-processing the bits of jute fibres through acid bath, while the acid used for acid bath is acetic acid with the concentration of above 90%. then, mixing the pectinase and laccase into complex enzyme, wherein the weight proportion of pectinase and laccase is 1:1, and the weight proportion of such complex enzyme and the jute fibres is 1:100; next, diluting the complex enzyme with water, in order to produce complex enzyme water solution which is 20 times in weight as much as the jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 30 minutes; after that, adjusting the PH value of the heated solution to 8.0 with sodium bicarbonate, heating the solution to 70° C., and keeping the solution at such temperature for 60 minutes; then, taking the jute fibres out of the solution, and accumulation storing the jute fibres for 10 hours; next, conducting enzyme deactivation of the accumulation stored jute fibres by washing the jute fibres with hot water at 85° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 22

An experiment is conducted through the following steps: firstly, dividing the jute fibres into several bits, wherein each bit of jute fibres weighs about 0.5 kilogram; secondly, pre-processing the bits of jute fibres through soaking the jute fibres in hydrogen peroxide with the concentration of 5 g/L. then, mixing the pectinase and laccase into complex enzyme, wherein the weight proportion of pectinase and laccase is 2:1, and the weight proportion of such complex enzyme and the jute fibres is 2:100; next, diluting the complex enzyme with water, in order to produce complex enzyme water solution which is 30 times in weight as much as the jute fibres; after that, soaking the jute fibres in the diluted complex enzyme water solution; then, adjusting the PH value of the diluted complex enzyme water solution to 5.3 with acetic acid and sodium bicarbonate; next, heating the complex enzyme water solution to 58° C. and keeping the solution at such temperature for 40 minutes; after that, adjusting the PH value of the heated solution to 7.8 with sodium bicarbonate, heating the solution to 69° C., and keeping the solution at such temperature for 90 minutes; then, taking the jute fibres out of the solution, and accumulation storing the jute fibres for 15 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 23

An experiment is conducted through the following steps: firstly, dividing the jute fibres into several bits, wherein each bit of jute fibres weighs 0.5 kilogram; secondly, pre-processing the bits of jute fibres through water bath, while the temperature of water bath is 100□, and the holding time is half an hours; then, mixing the pectinase and laccase into complex enzyme, wherein the weight proportion of pectinase and laccase is 5:1, and the weight proportion of such complex enzyme and the jute fibres is 3:100; next, diluting the complex enzyme with water, in order to produce complex enzyme water solution which is 12 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 55° C. and keeping the solution at such temperature for 50 minutes; after that, adjusting the PH value of the heated solution to 7.7 with sodium bicarbonate, heating the solution to 65° C., and keeping the solution at such temperature for 80 minutes; then, taking the jute fibres out of the solution, and accumulation storing the jute fibres for 20 hours; next, conducting enzyme deactivation of the accumulation stored jute fibres by washing the jute fibres with water solution, the PH value of which is 3.0; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 24

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 4:1, and the weight proportion of such complex enzyme and the jute fibres is 4:100; next, diluting the complex enzyme with water, in order to produce complex enzyme water solution which is 14 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 60° C. and keeping the solution at such temperature for 40 minutes; after that, adjusting the PH value of the heated solution to 8.0 with sodium bicarbonate, heating the solution to 65° C., and keeping the solution at such temperature for 70 minutes; then, taking the jute fibres out of the solution, and accumulation storing the jute fibres for 12 hours; next, conducting enzyme deactivation of the accumulation stored jute fibres by washing the jute fibres with water solution, the PH value of which is 11.0; finally, the degummed jute fibres are obtained. The removal rate of pectin and lignin from jute fibres is indicated in the table 1. The result of experiment shows that this is one of the most preferred embodiments of this invention.

Said degummed jute fibres will be highly spinnable, after being bleached, stamped, washed, dehydrated, and dried via the prior art.

EXAMPLE 25

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:3, and the weight proportion of such complex enzyme and the jute fibres is 1:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.2 with acetic acid and sodium bicarbonate; next, heating the complex enzyme water solution to 57° C. and keeping the solution at such temperature for 30 minutes; after that, adjusting the PH value of the heated solution to 8.0 with sodium bicarbonate, heating the solution to 60° C., and keeping the solution at such temperature for 100 minutes; then, taking the jute fibres out of the solution, and accumulation storing the jute fibres for 8 hours; next, conducting enzyme deactivation of the accumulation stored jute fibres by washing the jute fibres with hot water at 90° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 26

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 3:1, and the weight proportion of such complex enzyme and the jute fibres is 2:100; next, diluting the complex enzyme with water, in order to produce complex enzyme water solution which is 13 times in weight as much as jute fibres; after that, soaking the jute fibres in the diluted complex enzyme water solution; then, adjusting the PH value of the diluted complex enzyme water solution to 5.0 with acetic acid and sodium bicarbonate; next, heating the complex enzyme water solution to 58° C. and keeping the solution at such temperature for 25 minutes; after that, adjusting the PH value of the heated solution to 7.8 with sodium bicarbonate, heating the solution to 70° C., and keeping the solution at such temperature for 110 minutes; then, taking the jute fibres out of the solution; next, conducting enzyme deactivation of the jute fibres by washing the jute fibres with hot water, the PH value of which is 10.0 and the temperature of which is 75° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

EXAMPLE 27

An experiment is conducted through the following steps: firstly, dividing the jute fibres into several bits, wherein each bit of jute fibres weighs about 0.5 kilogram; secondly, mixing the pectinase and laccase into complex enzyme, wherein the weight proportion of pectinase and laccase is 2:1, and the weight proportion of such complex enzyme and the jute fibres is 1:100; next, diluting the complex enzyme with water, in order to produce complex enzyme water solution which is 16 times in weight as much as jute fibres; after that, soaking the jute fibres in the diluted complex enzyme water solution; then, adjusting the PH value of the diluted complex enzyme water solution to 5.4 with acetic acid and sodium bicarbonate; next, heating the complex enzyme water solution to 56° C. and keeping the solution at such temperature for 50 minutes; after that, adjusting the PH value of the heated solution to 7.6 with sodium bicarbonate, heating the solution to 55° C., and keeping the solution at such temperature for 100 minutes; then, taking the jute fibres out of the solution; next, conducting enzyme deactivation of the jute fibres by washing the jute fibres with hot water, the PH value of which is 3.5 and the temperature of which is 80° C.; finally, the degummed jute fibres are obtained. The removal rate of pectin and lignin from jute fibres is indicated in the table 1.

Said degummed jute fibres will be highly spinnable, after being bleached, stamped, washed, dehydrated, and dried via the prior art.

The pectinase (Bioprep) and the laccase (Denilite) mentioned in above examples are produced by the a Danish company called Novozymes. Table 1 illustrates the removal rates of pectin and lignin.

TABLE 1

| Examples | 1 | 2 | 3 | 4 | 5 | 6 | 7 | 8 | 9 |
|---|---|---|---|---|---|---|---|---|---|
| Removal rate of pectin | 86% | 95% | 92% | 91% | 95% | 96% | 91% | 90% | 87% |
| Removal rate of lignin | 80% | 79% | 80% | 82% | 84% | 86% | 82% | 79% | 78% |
| Examples | 10 | 11 | 12 | 13 | 14 | 15 | 16 | 17 | 18 |
| Removal rate of pectin | 89% | 95% | 94% | 94% | 96% | 96% | 91% | 95% | 89% |
| Removal rate of lignin | 86% | 79% | 87% | 86% | 81% | 88% | 86% | 82% | 81% |
| Examples | 19 | 20 | 21 | 22 | 23 | 24 | 25 | 26 | 27 |
| Removal rate of pectin | 88% | 96% | 91% | 90% | 95% | 96% | 91% | 91% | 89% |
| Removal rate of lignin | 79% | 80% | 80% | 80% | 84% | 86% | 78% | 80% | 78% |

While this invention has been described as having several preferred embodiments, the present invention can be further modified within the spirit and scope of this disclosure. This application is therefore intended to cover any variations, uses, or adaptations of the invention using its general principles. Further, this application is intended to cover such departures from this present disclosure as come within known or customary practice in the art to which this invention pertains and which fall within the limits of the appended claims.

The invention claimed is:

1. A method of degumming jute fibres with complex enzyme, wherein said complex enzyme comprises pectinase and laccase, comprising the steps of:

Preprocessing jute fibers by exposure of the fibers to a water bath at a temperature of 100 degrees C. for one-half hour;

soaking the jute fibres in a water solution of said complex enzyme made from pectinase and laccase, where the weight proportion of pectinase and laccase is 5:1 and the weight proportion of the complex enzyme and jute fibers is 3:100, and the weight proportion of said complex enzyme water solution to jute fibres is 12:1;

adjusting pH value of said complex enzyme water solution to 5.1, and adjusting the temperature of said complex enzyme water solution to 60° Centigrade, then keeping said complex enzyme water solution with such temperature for 60 minutes;

adjusting the pH value of said complex enzyme water solution to more than 8.0, but not more than 9.5, and adjusting the temperature of said complex enzyme water solution to 40° C.-70° C.; then, keeping said complex enzyme water solution at such temperature for 20-120 minutes;

removing the jute fibers from the complex enzyme water solution and storing the jute fibers for twenty hours; and conducting enzyme deactivation of the jute fibres processed with said complex enzyme by washing the jute fibers with with an aqueous solution having a pH of 11.0. obtaining degummed jute fibers.

2. A method of degumming jute fibres with complex enzyme, wherein said complex enzyme comprises pectinase and laccase, comprising the steps of:

Dividing jute fibers into bits that weigh about 0.5 kilograms;

soaking the jute fibre bites in a water solution of said complex enzyme made from pectinase and laccase having a weight ratio of 4:1 pectinase to laccase, where the weight proportion of said complex enzyme water solution and jute fibre bits is 14:1, and the weight proportion of said complex enzyme and said jute fibres is 4:100;

adjusting pH value of said complex enzyme water solution to 5.2 with acetic acid and sodium bicarbonate, and adjusting the temperature of said complex enzyme water solution to 58° C., then keeping said complex enzyme water solution with such temperature for 70 minutes;

adjusting the pH value of said complex enzyme water solution to 9.0 with sodium bicarbonate, and adjusting the temperature of said complex enzyme water solution to 40° C.; then, keeping said complex enzyme water solution at such temperature for 90 minutes;

removing the jute fiber bits from the complex enzyme water solution and storing the fibers for twelve hours;

conducting enzyme deactivation of the jute fibres processed with said complex enzyme by washing the jute fibers with a water solution having a pH of 3.0, obtaining degummed jute fibers.

* * * * *